US005337666A

United States Patent [19]

Becker

[11] Patent Number: 5,337,666

[45] Date of Patent: Aug. 16, 1994

[54] DEVICE FOR FASTENING AND CHANGING THE POSITION OF A CYLINDER DRESSING

[75] Inventor: Willi Becker, Bammental, Fed. Rep. of Germany

[73] Assignee: Heidelberger Druckmaschinen AG, Heidelberg, Fed. Rep. of Germany

[21] Appl. No.: 89,012

[22] Filed: Jul. 8, 1993

[30] Foreign Application Priority Data

Jul. 8, 1992 [DE] Fed. Rep. of Germany ..... 4222332

[51] Int. Cl.[5] ..... B41F 1/28

[52] U.S. Cl. ..... 101/415.1

[58] Field of Search ..... 101/216, 246, 247, 248, 101/415.1, 408, 409, 410, 411

[56] References Cited

U.S. PATENT DOCUMENTS

| | | | |
|---|---|---|---|
| 2,837,994 | 6/1958 | Brodie | 101/415.1 |
| 2,850,970 | 9/1958 | Brodie | 101/415.1 |
| 2,929,323 | 3/1960 | Burgard | 101/415.1 |
| 3,335,663 | 8/1967 | Harenza | 101/415.1 |
| 3,605,621 | 9/1971 | Woessner et al. | 101/415.1 |
| 4,587,901 | 5/1986 | Gianfranco | 101/415.1 |
| 4,815,380 | 3/1989 | Fischer | 101/415.1 |
| 5,069,127 | 12/1991 | Iijima et al. | 101/415.1 |

*Primary Examiner*—Eugene H. Eickholt

*Attorney, Agent, or Firm*—Herbert L. Lerner; Laurence A. Greenberg

[57] ABSTRACT

Device for fastening and changing the position of a cylinder dressing on a printing-unit cylinder formed with an axially parallel gap in a rotary printing press includes, within the gap, tensioning spindles connectible with respective leading and trailing edges of a cylinder dressing disposed on the outer cylindrical surface of the printing-unit cylinder for applying tension to the cylinder dressing, the tensioning spindles being formed with toothing, respective shafts formed with toothing meshing with the toothing on the respective tensioning spindles, a device operatively connected to at least one of the tensioning spindles for adjusting the position of the cylinder dressing on the printing-unit cylinder, an actuating drive mounted on an end face of the printing-unit cylinder and operatively connected with the tensioning spindles for moving the spindles so that the cylinder dressing is both subjected to tension in circumferential direction of the printing-unit cylinder simultaneously at the leading and trailing edges thereof and also adjustable in position on the printing-unit cylinder in a defined manner by the adjusting device.

11 Claims, 5 Drawing Sheets

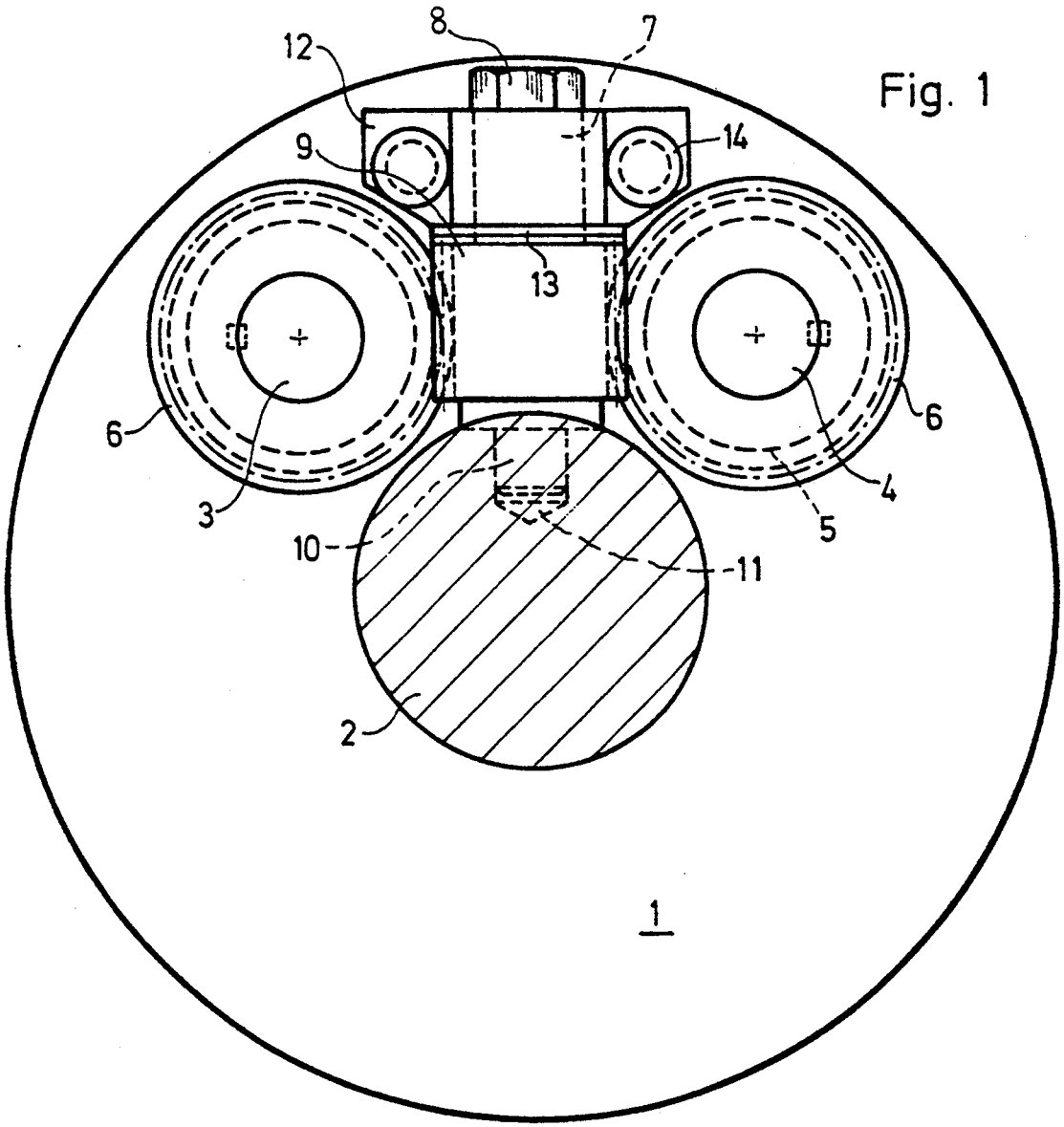
Fig. 1
Fig. 1a
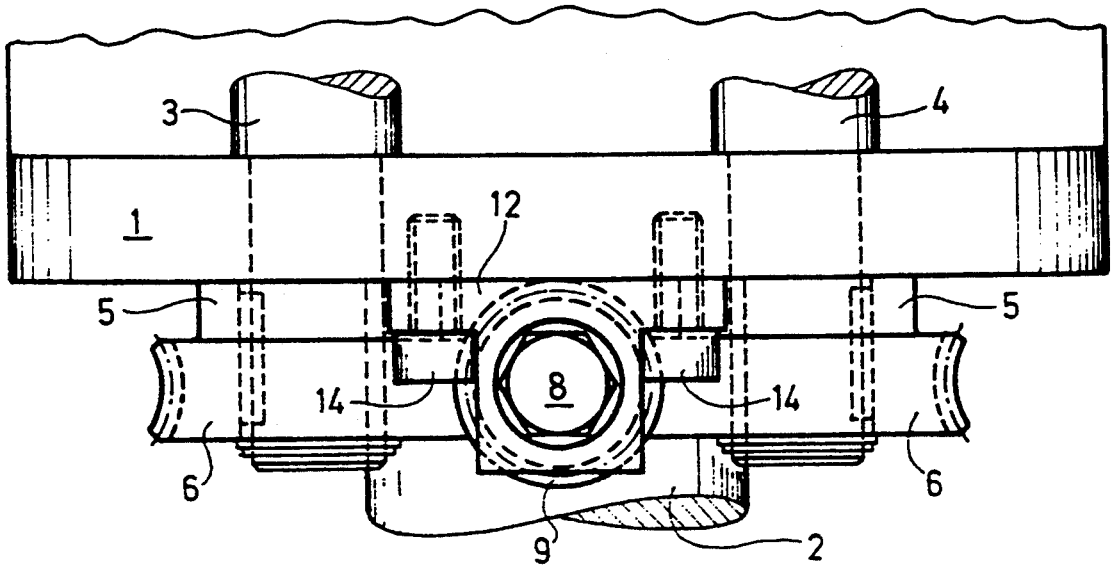

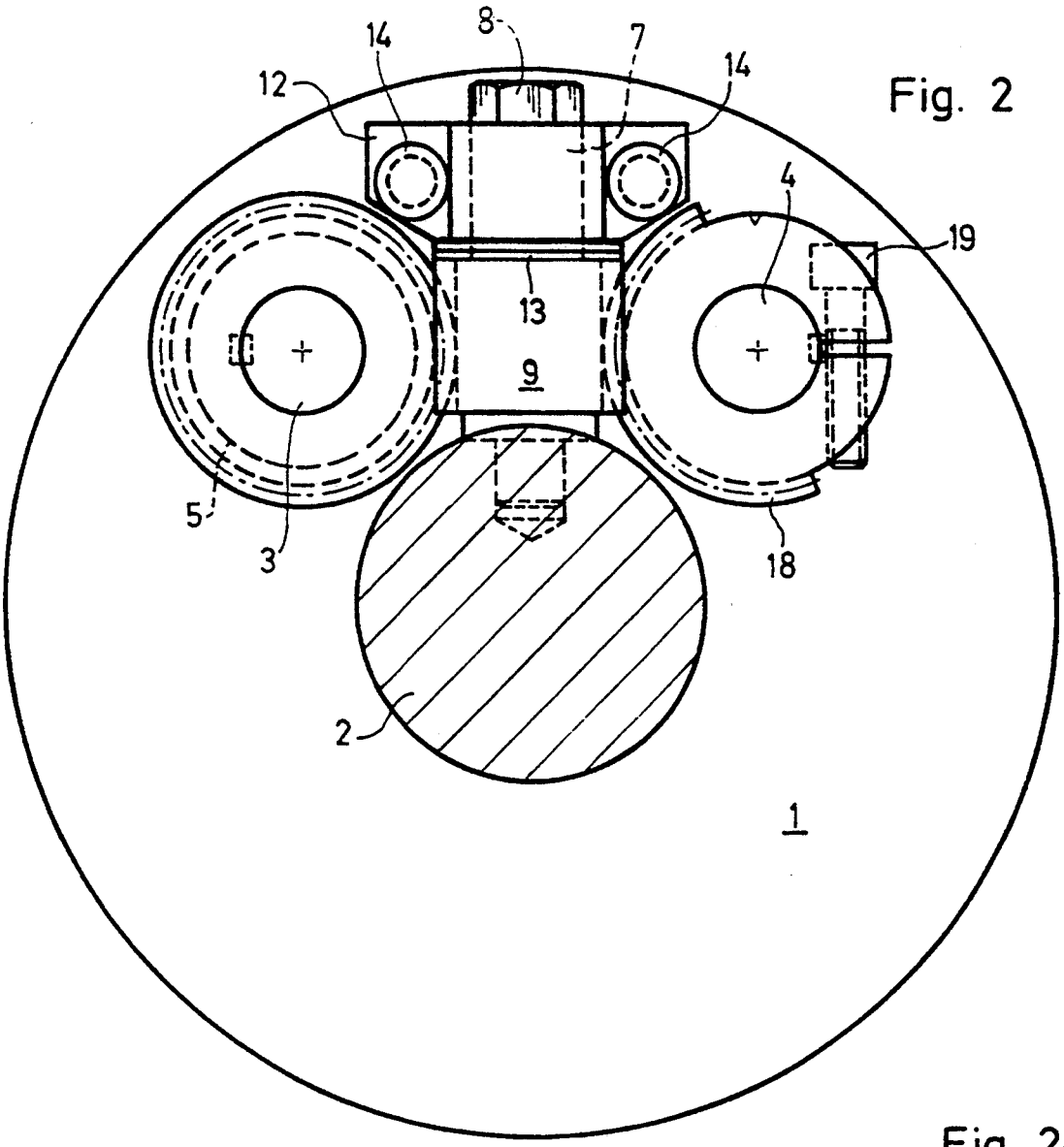
Fig. 2
Fig. 2a
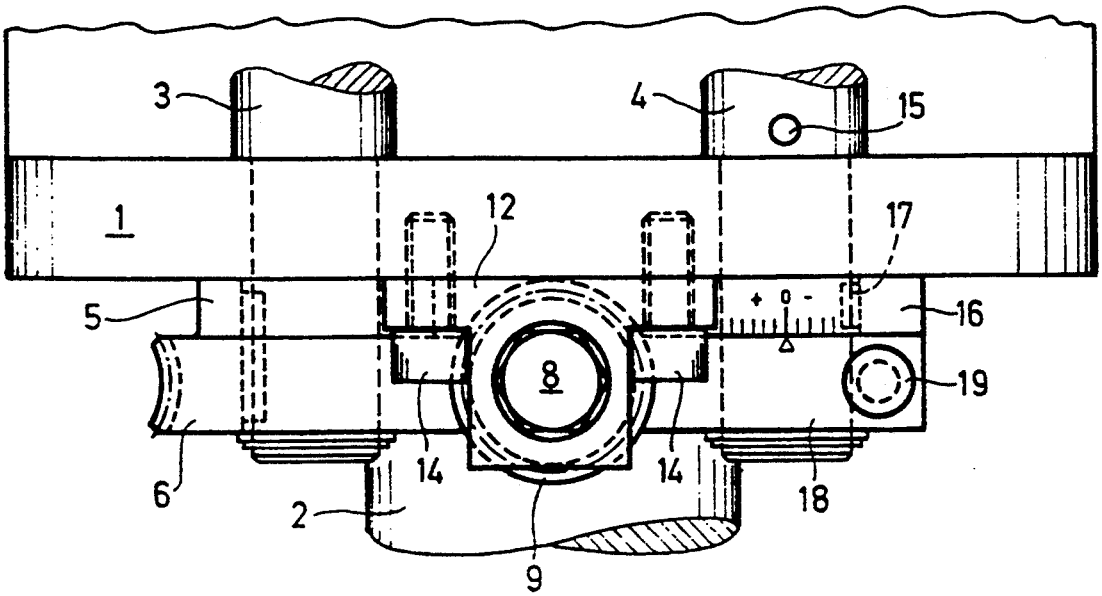

Fig. 3
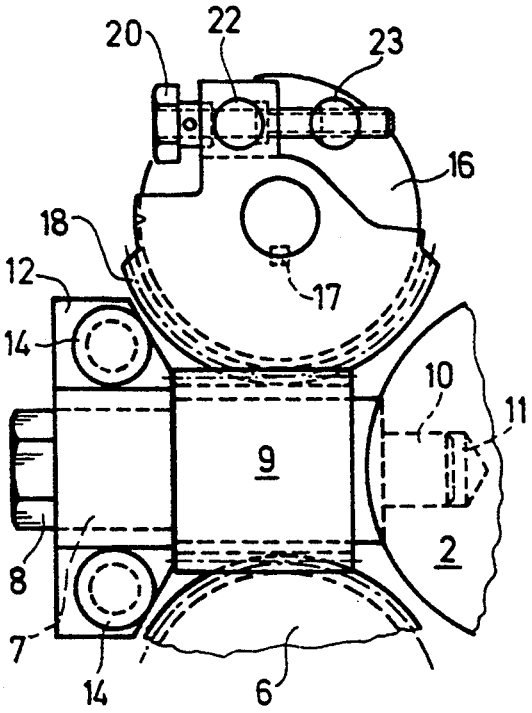
Fig. 4
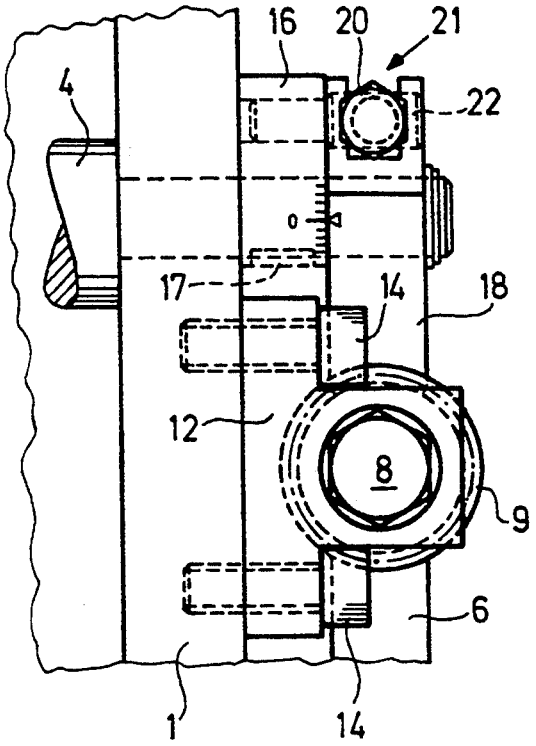
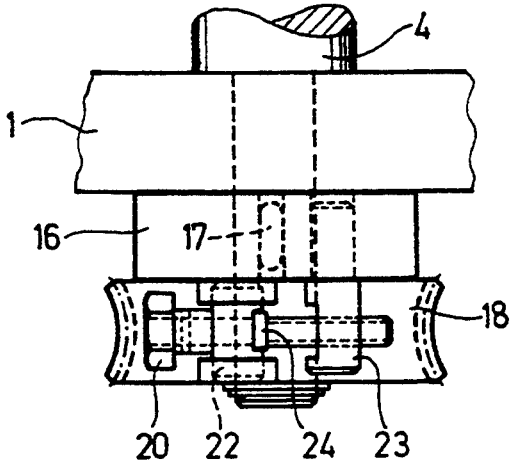
Fig. 5
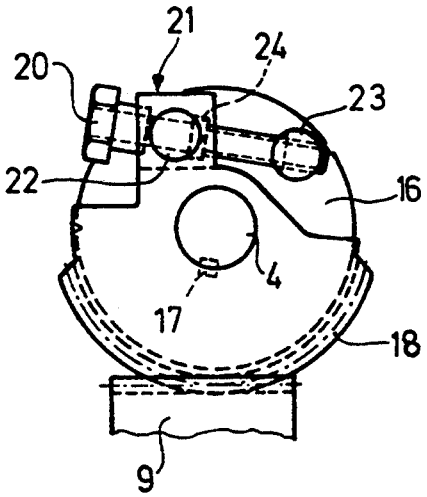
Fig. 6

DEVICE FOR FASTENING AND CHANGING THE POSITION OF A CYLINDER DRESSING

The invention relates to a device for fastening and changing the position of a cylinder dressing on a printing-unit cylinder formed with an axially parallel groove or gap in a rotary printing press, wherein at least one tensioning spindle for applying tension to a cylinder dressing is provided.

Heretofore known from German Published Patent Document 40 11 303 A1 is a device for fastening a rubber blanket on a blanket cylinder of an offset printing press. An upper rail and a lower rail are fixed in a blanket cylinder by means of a locking screw. Between the two rails, V-shaped recesses wherein the ends of a rubber blanket are received. A disadvantage of this heretofore known device of the prior art is that it does not permit any positional displacement of the rubber blanket on the surface of the blanket cylinder.

Conversely, German Published Patent Document 29 10 880 C2 discloses a rubber-blanket tensioning device wherein two tensioning spindles have straight-toothed annular teeth which mesh with annular teeth of a toothed rack which, in turn, is held by a threaded bolt. The threaded bolt is disposed in the base of the groove formed in the blanket cylinder and is movable in a thread. A disadvantage of the rubber blanket-tensioning device of this German publication is that only a limited tensioning travel is available. Furthermore, there is no possibility of correcting the position of the rubber blanket on the blanket cylinder. The straight toothing of the annular teeth permits only a point contact between respective tooth flanks or sides, resulting in very high Hertzian stresses, which may cause premature wear. Further-more, the tightness or stiffness in the operation of this conventional rubber blanket-tensioning device is disadvantageous, because it is necessary to overcome both tooth-related friction as well as thread-related friction during operation thereof.

The Japanese Patent 58-177360 describes a device for tensioning a rubber blanket for printing presses. In this heretofore known device, two tensioning spindles received in a printing-unit cylinder are each provided with an actuating drive formed of a worm wheel and a worm. A disadvantage of this device of the Japanese patent, however, is that, when the rubber blanket or the underlay therefor is changed, it is necessary to move backwards and forwards between the two tensioning locations, which is time-consuming.

Starting from the prior art outlined hereinbefore, it is an object of the invention to provide a device for fastening and changing the position of a cylinder dressing wherein the service life of the cylinder dressing is prolonged, accompanied by an enhanced ease of operation of the device.

With the foregoing and other objects in view, there is provided, in accordance with the invention, a device for fastening and changing the position of a cylinder dressing on a printing-unit cylinder formed with an axially parallel gap in a rotary printing press, comprising, within the gap, tensioning spindles connectible with respective leading and trailing edges of a cylinder dressing disposed on the outer cylindrical surface of the printing-unit cylinder for applying tension to the cylinder dressing, the tensioning spindles being formed with toothing, respective shafts formed with toothing meshing with the toothing on the respective tensioning spindles, means operatively connected to at least one of the tensioning spindles for adjusting the position of the cylinder dressing on the printing-unit cylinder, an actuating drive mounted on an end face of the printing-unit cylinder and operatively connected with the tensioning spindles for moving the spindles so that the cylinder dressing is both subjected to tension in circumferential direction of the printing-unit cylinder simultaneously at the leading and trailing edges thereof and also adjustable in position on the printing-unit cylinder in a defined manner by the adjusting means.

An advantage of the foregoing construction according to the invention is that the tensioning spindles are operated through the intermediary of a common actuating drive. It is then no longer necessary to advance the leading and trailing rubber-blanket tensioning locations step by step. This permits a considerable reduction in setting-up time when changing the cylinder dressing or the underlay therefor, due to the contact-pressure adjustment. Moreover, it then becomes possible to vary the position of the cylinder dressing on the outer surface of the printing-unit cylinder. Consequently, the edge of the cylinder dressing entering the cylinder gap, which is exposed to heavy mechanical stresses, can be shifted into the region of the cylinder gap, i.e., a compression-free space. This results in a considerable lengthening of the service life of the cylinder dressing.

In accordance with another feature of the invention, the shafts have, on a respective part thereof facing out of the gap, means for engageably receiving an adjusting tool.

In accordance with a further feature of the invention, a toothed segment is mounted on at least one of the tensioning spindles, and clamping means are provided for fixing the toothed segment in varying positions in circumferential direction of the one tensioning spindle. The distance covered by the tensioning travel is thereby able to be adjusted to specific cylinder dressings. Furthermore, the position of the cylinder dressing on the circumference of the printing-unit cylinder is controllable by adjusting screws on at least one of the tensioning spindles. This provides the possibility of rotating at least one of the tensioning spindles with respect to the cylinder dressing covering in such a manner that, after renewed tensioning of the cylinder dressing, the latter has been moved circumferentially on the printing-unit cylinder relative to the original position thereof. Thus, in accordance with an added feature of the invention, the adjusting means on the at least one tensioning spindle is actuatable for controlling the position of the cylinder dressing on the circumference of the printing-unit cylinder.

Moreover, in accordance with an additional feature of the invention, the adjusting means include a scale body indicating angular rotation disposed on the at least one tensioning spindle.

In accordance with yet another feature of the invention, at least one of the tensioning spindles, at a region of the printing-unit cylinder located at the end face thereof, is formed with an opening for receiving a tool therein for adjusting the one tensioning spindle. This permits the pressman to turn the one tensioning spindle through an adjusting travel distance which is readable from the scale body, after the rubber blanket or other cylinder dressing has been relieved of tension by the actuating drive, and the toothed-segment clamping at the one tensioning spindle has been released.

In accordance with yet a further feature of the invention, the toothed segment is formed with a fork, and the adjusting means comprise adjusting elements disposed in the fork.

In accordance with yet an added feature of the invention, one of the adjusting elements is a bearing pin journalled in respective tines of the fork, and another of the adjusting elements is movably mounted in the bearing pin.

In accordance with yet an additional feature of the invention, the other adjusting element is formed as a setscrew, and the adjusting means include an adjusting pin carried by the setscrew and movable thereby on a circular path. In this regard, the circular path is about the center of the tensioning shaft. Thus, it is possible, in an advantageous manner, to achieve a very precise displacement of the cylinder dressing in accordance with or as a function of the thread pitch of the setscrew, thereby permitting very small displacements of the cylinder dressing on the outer cylindrical surface of the printing-unit cylinder. Those regions of the cylinder dressing which are exposed to heavy mechanical stressing can then be shifted into mechanically non-critical regions, thereby considerably prolonging the service life of the cylinder dressing.

In accordance with another feature of the invention, the adjusting means include a scale body indicating angular rotation mounted on the at least one tensioning spindle so as to be fixed against rotation relative thereto, the adjusting pin being in engagement with the scale body. Assurance is thereby provided that the rotation or turning applied to the tensioning spindle in accordance with the rotation or turning of the setscrew can be read off the scale body, while the toothed segment carrying the adjusting elements remains at rest.

In accordance with a concomitant feature of the invention, the setscrew is turnable on at least one of the tensioning spindles for relieving tension in the cylinder dressing via the scale body and the adjusting pin, at least one of the tensioning spindles being turnable relative to the tension-relieved cylinder dressing due to a turning of the setscrew.

Other features which are considered as characteristic for the invention are set forth in the appended claims.

Although the invention is illustrated and described herein as embodied in a device for fastening and changing the position of a cylinder dressing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a side elevational view of an embodiment of an actuating drive with worm wheels according to the invention located on an end face of a printing-unit cylinder;

FIG. 1*a* is a broken-away top plan view of FIG. 1;

FIG. 2 is a view like that of FIG. 1 of another embodiment of the actuating drive having a toothed segment;

FIG. 2*a* is a broken-away top plan view of FIG. 2;

FIG. 3 is a fragmentary view of FIG. 2, rotated clockwise through 90 degrees and showing a further embodiment of the actuating drive with a toothed segment having actuators fastened thereto;

FIG. 4 is a top plan view of FIG. 3;

FIG. 5 is a side elevational view of FIG. 3 showing the toothed segment in greater detail;

FIG. 6 is a fragmentary view of FIG. 3 showing the toothed segment in another operating phase thereof wherein one of the tensioning spindles has been turned through the intermediary of an actuating screw.

Figure 7:
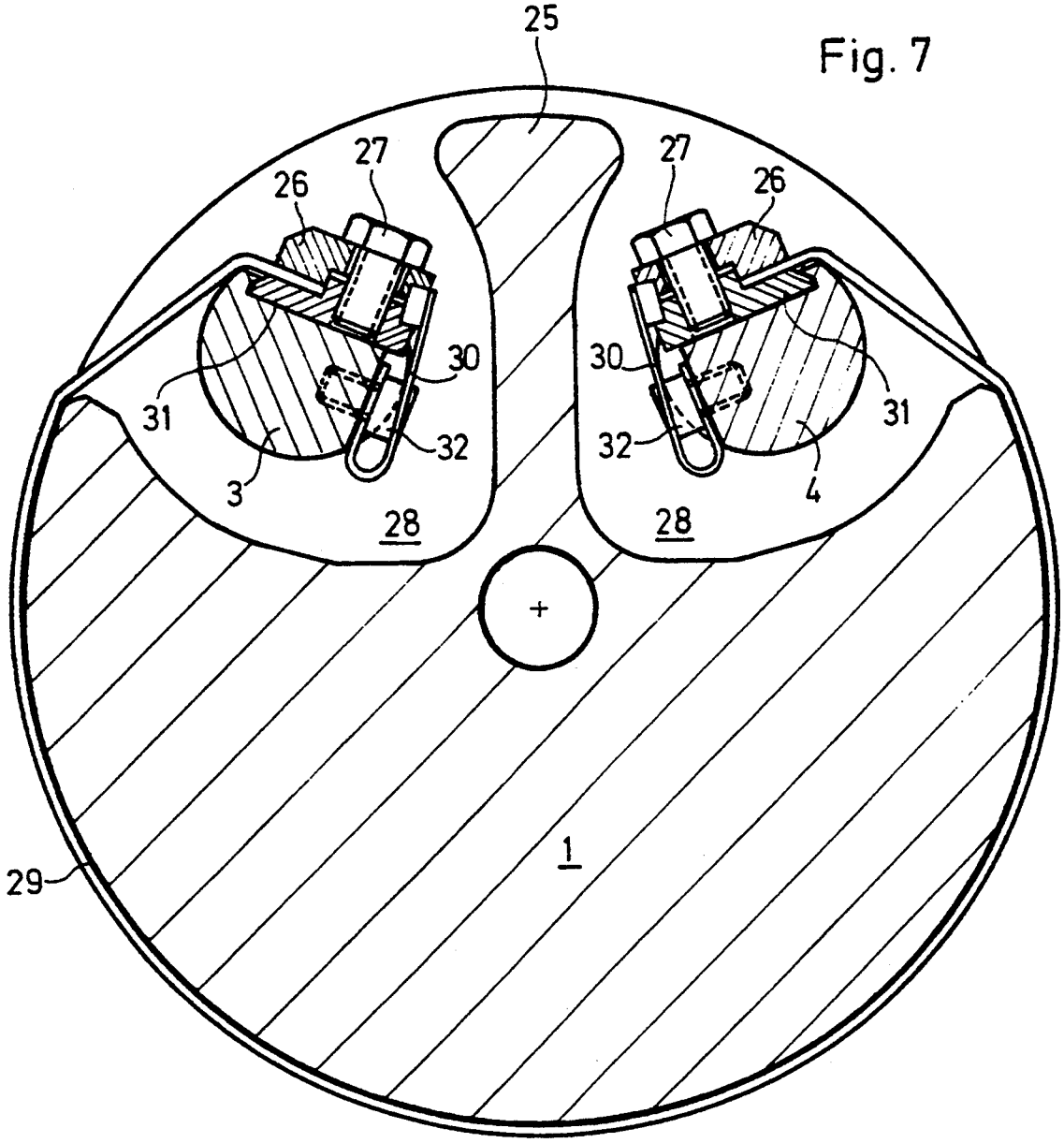
FIGS. 7 and 8 are respective cross-sectional views of a printing-unit cylinder showing different positions of a cylinder dressing on the outer cylindrical surface thereof.

Referring now to the drawings and, first, particularly to FIG. 1 thereof, there is shown therein, in a side elevational view, an actuating drive with worm wheels on an end face of a printing-unit cylinder 1. The printing-unit cylinder 1 accommodates two tensioning spindles 3 and 4 at each of the end faces thereof. Disposed with a form-locking connection on each of the tensioning spindles 3 and 4 is a worm wheel 6 which is in contact, through the intermediary of a collar 5, with an end face of the printing-unit cylinder 1. In regard to the foregoing, it is noted that a form-locking connection is one which connects two elements together due to the shape of the elements themselves, as opposed to a force-locking connection, which locks the elements together by force external to the elements. An actuating shaft 7 is supported in a bearing block 12 attached by bolts 14 to the end face of the printing-unit cylinder 1. Mounted on the actuating shaft 7 is a worm 9, which is in meshing engagement with the two worm wheels 6, respectively, of the tensioning spindles 3 and 4. The upper part of the actuating shaft 7, as viewed in FIG. 1, is provided with an actuating head 8, by which the actuating shaft 7 is moved. The lower end of the actuating shaft 7, namely the shaft end 10, is rotatably received in a bore 11 formed in a journal 2 of the cylinder 1. Located between the worm 9 and the bearing block 12 is an axial bearing 13, through which the torque required for operating the actuating shaft 7 is reduced.

It is, moreover, apparent from FIG. 1*a*, that the worm wheels 6 are held by feather keys on the ends of the respective tensioning spindles 3 and 4.

FIG. 2 shows an actuating drive with a toothed segment mounted on an end face of the printing-unit cylinder 1. In this embodiment of the invention, the worm wheel 6 of FIGS. 1 and la is replaced by a toothed segment 18 on the tensioning spindle 4. A force-locking connection between the toothed segment 18 and the tensioning spindle 4 can be undone by a clamping screw 19; the power transfer between actuating drive and tensioning spindle 4 can therefore be interrupted at this location. In regard to the foregoing, it is noted that a force-locking connection is one which connects two elements together by force external to the elements, as opposed to a form-locking connection which is effected by the shapes of the elements themselves. It is apparent from FIG. 2*a* that, in this embodiment of the invention, instead of a collar 5, as in the embodiment of FIGS. 1 and 1*a*, a scale body 16 is form-lockingly connected to the tensioning spindle 4 by means of a feather key 17. The zero point on the scale of the scale body 16 is shown located opposite a notch on the toothed segment 18. In addition, the tensioning spindle 4 is formed with an opening 15 for the application of a suitable tool.

When the printing press is at rest, the pressman initially operates the tensioning spindles 3 and 4 through the intermediary of the actuating head 8 of the actuating drive and releases the tension on the cylinder dressing. After loosening the clamped connection at the clamping screw 19, the tensioning spindle 4 can be turned, through the intermediary of a tool applied into the opening 15, in one or the other other circumferential direction with respect to the toothed segment 18. During this operation, the toothed segment 18 remains in its rest position due to the self-locking between the worm 9 and the teeth on the toothed segment 18 and can, therefore, be used as a reference point for the quantitative evaluation of the turning travel or distance of the tensioning spindle 4. After an appropriate turning of the tensioning spindle 4, the friction-type connection between the tensioning spindle 4 and the toothed segment 18 is re-established by tightening the clamping screw 19. Thereafter, a cylinder dressing is subjected to tension by turning the actuating shaft 7 through the intermediary of the actuating head 8. A cylinder dressing then assumes a different position in the circumferential direction on the printing-unit cylinder 1 in relation to its original position.

FIG. 3 shows a toothed segment carrying a plurality of actuators. In this embodiment of the device according to the invention, a toothed segment 18 is operated through the intermediary of an actuating shaft 7 which is supported in a manner analogous to that shown in FIGS. 1 and 2. The actuating shaft 7 is supported, at one end thereof, in the bearing block 12 and, at the other end thereof, by the shaft end 10 in the hole 11 formed in the cylinder journal 2. In this embodiment, the toothed segment 18 is configured in a manner that an actuating screw 20 is turnably received in a bearing pin 22. The actuating screw 20 penetrates the bearing pin 22 and, when turned, moves an actuating pin 23 on a circular path. The actuating pin 23, in turn, is turnably received in the scale body 16.

FIG. 4 is a top plan view of the embodiment shown in FIG. 3. The toothed segment 18 is provided, at the actuating-screw end, with a fork 21 which is bridged by the turnably mounted bearing pin 22. The actuating pin 23 is received, as indicated by the broken lines, in the scale body 16. The scale body 16, in turn, has a form-locking connection, analogous to that in FIG. 2*a*, with the tensioning spindle 4 by means of a feather key 17. The side view of the toothed segment 18 in FIG. 5 clearly shows that, when the actuating screw 20 is turned in the bearing pin 22, the actuating pin 23, which is held in the scale body 16, turns the latter and, through the intermediary of the feather key 17, the tensioning spindle 4.

FIG. 6 shows the tensioning spindle 4 being turned through the intermediary of an actuating screw. The scale body 16, which is located behind the toothed segment 18 (which is held in its position by the worm 9), is shown in a different rotational phase position than the rotational phase position thereof illustrated in FIG. 3. Because the scale body 16 is form-lockingly connected to the tensioning spindle 4, the rotation of the tensioning spindle 4 becomes apparent from a comparison of the rotational positions of the feather key 17 in FIGS. 3 and 6. In order to compensate for the swivelling movement of the actuating pin 23 occurring during the turning of the scale body 16, the actuating screw 20 is movable in the fork 21 of the toothed segment 18.

It should be noted that it is perfectly possible for both of the tensioning spindles 3 and 4 to be connected to a toothed segment 18 which is variably fixable in circumferential direction, whether in the embodiment shown in FIGS. 2 and 2*a* or in the embodiment illustrated in FIG. 3, 4, 5 and 6. The area available for the displacement of the cylinder dressing or blanket on the outer surface of the printing-unit cylinder 1 is thereby increased.

Figure 8:
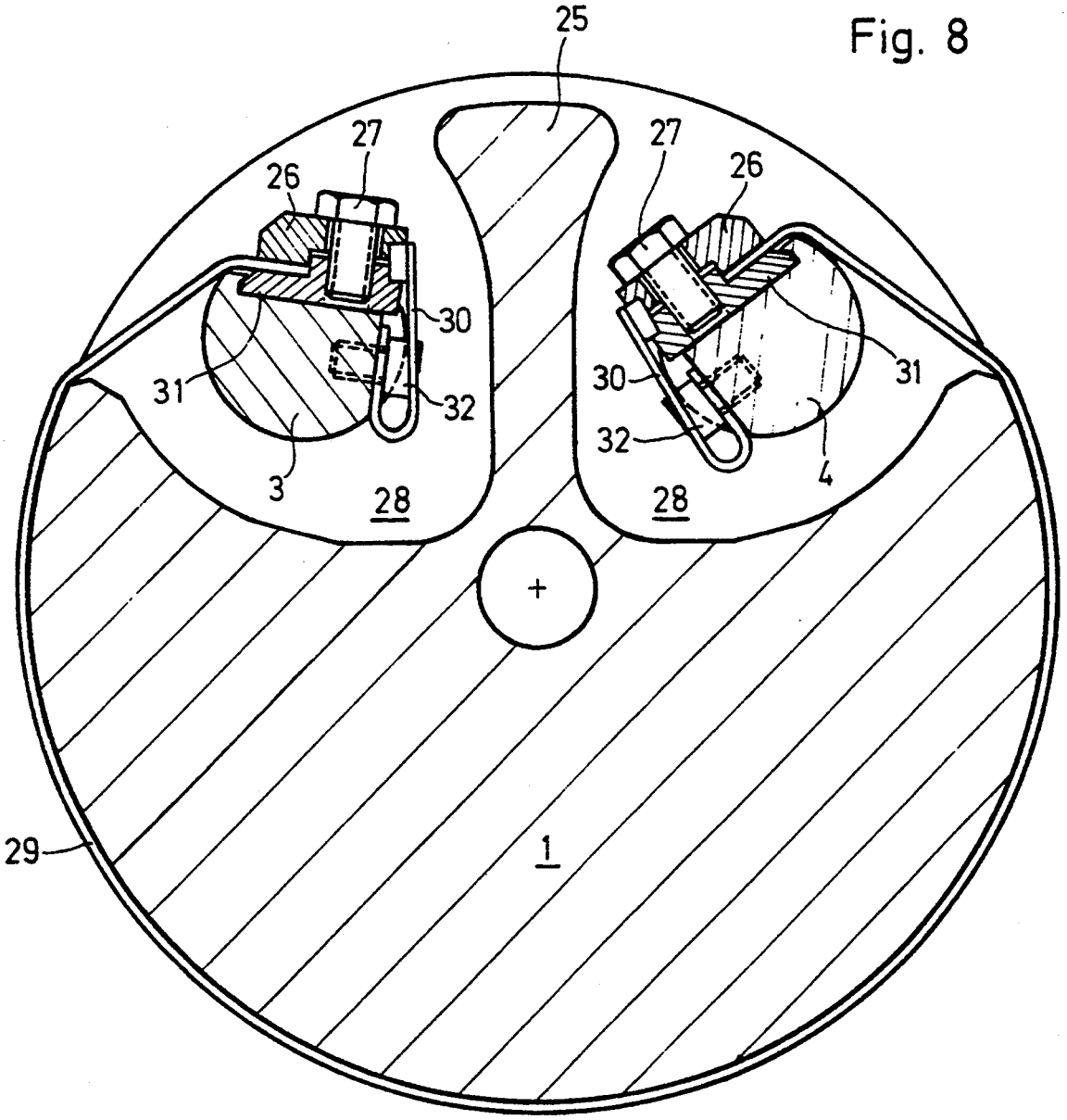

FIGS. 7 and 8 show a cylinder dressing 29 fixed in different positions on the outer surface of a printing-unit cylinder 1.

By means of a wall-like cross-piece 25 provided on the printing-unit cylinder 1, an axially parallel groove or gap formed in the printing-unit cylinder 1 is divided into two axially parallel recesses 28, each of which accommodates one of the tensioning spindles 3 and 4. The tensioning spindles 3 and 4 are each provided with a lower clamping rail 31, as viewed in FIGS. 7 and 8, which accommodates an upper clamping rail 26 thereon, through the intermediary of screws 27. Respective ends of the cylinder dressing or blanket 29 are received between the respective upper clamping rail 26 and the respective lower clamping rail 31. In order to hold the respective clamping-rail pair 26,31 on the respective tensioning spindles 3 and 4 during tensioning, the respective clamping rails 31 are connected to respective holding clips or clasps 30 which, in turn, are attached to the respective tensioning spindles 3 and 4 through the intermediary of respective bolts 32. In FIG. 7, the tensioning spindles 3 and 4 are disposed more-or-less symmetrically with respect to one another, which corresponds somewhat to a first mounting position of a new cylinder dressing 29 on the outer surface of the printing-unit cylinder 1. After a given period of service, it is then possible, employing the device according to the invention, to move the cylinder dressing 29 on the outer surface of the printing-unit cylinder 1 with respect to the original position thereof shown in FIG. 7. Thus, for example, the region or portion of the cylinder dressing 29 clamped on the tensioning spindle 4 can be moved into the region of the recess 28, where there is no mechanical stressing, if the edge portion of the cylinder dressing 29 introduced into the groove or gap should become hard or porous. Minor damage to the cylinder dressing 29 caused, for example, by paper jams, may thereby possibly be moved to nonprinting areas.

The foregoing is a description corresponding in substance to German Application P 42 22 332.6, dated Jul. 8, 1992, the International priority of which is being claimed for the instant application, and which is hereby made part of this application. Any material discrepancies between the fore-going specification and the aforementioned corresponding German application are to be resolved in favor of the latter.

I claim:

1. Device for fastening and changing the position of a cylinder dressing on a printing-unit cylinder formed with an axially parallel gap in a rotary printing press, comprising, within the gap, tensioning spindles connectible with respective leading and trailing edges of a cylinder dressing disposed on the outer cylindrical surface of the printing-unit cylinder for applying tension to the cylinder dressing, said tensioning spindles being formed with toothing, a shaft formed with toothing meshing with said toothing on the respective tensioning spindles, means operatively connected to at least one of said tensioning spindles for adjusting the position of the cylinder dressing on the printing-unit cylinder, an actuating drive mounted on an end face of the printing-unit cylinder and operatively connected with said tensioning spindles for moving said spindles so that the cylinder dressing is both subjected to tension in circumferential direction of the printing-unit cylinder simultaneously at the leading and trailing edges thereof and also adjustable in position on the printing-unit cylinder in a defined manner by said adjusting means.

2. Device according to claim 1, wherein said shaft has, on a respective part thereof facing out of the gap, means for engageably receiving an adjusting tool.

3. Device according to claim 1, including a toothed segment mounted on at least one of said tensioning spindles, and clamping means for fixing said toothed segment in varying positions in circumferential direction of said one tensioning spindle.

4. Device according to claim 1, wherein said adjusting means on said at least one tensioning spindle is actuatable for controlling the position of the cylinder dressing on the circumference of the printing-unit cylinder.

5. Device according to claim 1, wherein said adjusting means include a scale body indicating angular rotation disposed on said at least one tensioning spindle.

6. Device according to claim 1, wherein at least one of the tensioning spindles, at a region of the printing-unit cylinder located at the end face thereof, is formed with an opening for receiving a tool therein for adjusting the one tensioning spindle.

7. Device according to claim 3, wherein said toothed segment is formed with a fork, and said adjusting means comprise adjusting elements disposed in said fork.

8. Device according to claim 7, wherein one of said adjusting elements is a bearing pin journalled in respective tines of said fork, and another of said adjusting elements is movably mounted in said bearing pin.

9. Device according to claim 8, wherein said other adjusting element is formed as a setscrew, and said adjusting means include an adjusting pin carried by said setscrew and movable thereby on a circular path.

10. Device according to claim 9, wherein said adjusting means include a scale body indicating angular rotation mounted on said at least one tensioning spindle so as to be fixed against rotation relative thereto, said adjusting pin being in engagement with said scale body.

11. Device according to claim 10, wherein said setscrew is turnable on at least one of the tensioning spindles for relieving tension in the cylinder dressing via said scale body and said adjusting pin, at least one of the tensioning spindles being turnable relative to the tension-relieved cylinder dressing due to a turning of said setscrew.

* * * * *